US007752790B1

(12) United States Patent
Michael et al.

(10) Patent No.: US 7,752,790 B1
(45) Date of Patent: Jul. 13, 2010

(54) DISPLAY DEVICE

(76) Inventors: Daryl A. Michael, 1169 S. 52nd Ave. East, Newton, IA (US) 50208; Jennifer L. Michael, 1169 S. 52nd Ave. East, Newton, IA (US) 50208

( * ) Notice: Subject to any disclaimer, the term of this patent is extended or adjusted under 35 U.S.C. 154(b) by 101 days.

(21) Appl. No.: 12/150,875

(22) Filed: May 1, 2008

Related U.S. Application Data

(60) Provisional application No. 60/927,453, filed on May 3, 2007.

(51) Int. Cl.
*G09F 13/22* (2006.01)

(52) U.S. Cl. ..... 40/544; 40/594; 362/368; 362/397

(58) Field of Classification Search ..... 40/541
See application file for complete search history.

(56) References Cited

U.S. PATENT DOCUMENTS

| | | | | |
|---|---|---|---|---|
| 5,533,289 | A | 7/1996 | Hoffman | |
| 6,013,346 | A * | 1/2000 | Lewis et al. | 428/78 |
| 7,065,910 | B2 | 6/2006 | Woodruff | |
| 7,293,719 | B2 | 11/2007 | Wheatley et al. | |
| 7,300,193 | B2 | 11/2007 | Xie | |

* cited by examiner

*Primary Examiner*—Cassandra Davis
(74) *Attorney, Agent, or Firm*—Allan P. Orsund

(57) ABSTRACT

A lighted display device that includes components that are over molded or encased in a polymer gel. The polymer gel exhibits a high surface coefficient of friction such that the gel has a tacky surface and allows the display device to cling to a surface of any orientation. The polymer gel is clear or translucent such that the over molded components, which include light emitting components, can back or front light a display. The polymer gel can be flat on its sides or include three dimensional protrusions or inclusions on the surfaces.

16 Claims, 13 Drawing Sheets

DISPLAY DEVICE

BACKGROUND OF THE INVENTION

The present invention relates generally to the field of lighted display devices or signs that may be used for, but not limited to, decoration, education and advertising. Current construction for lighted display devices or signs includes a wide variety of technologies and methodologies. Lighted signs can be made from a simple light box with images placed on a translucent panel covering a side or sides of the light box. The light box can then be placed in a window or storefront for display. The light box can also be set on a stand or hung in a window by utilizing hardware such as hooks and chains. Other types of lighted signs or displays include neon lights or simple static cling signage that is backlit with ambient lighting.

Various prior lighting devices have shown and include the creation of simple lighted displays by mounting lighting components such as light emitting diodes (LEDs) or electroluminescent film on the back of a static cling film to back light images on the film.

BRIEF SUMMARY OF THE INVENTION

The present invention is directed to creating a lighted display device having a body formed from a polymeric gel material having adherent or tacky surface qualities. Lighting for the display device is provided by fully or at least partially embedding, over molding or enclosing light emitting components such as light emitting diodes, bulbs, electroluminescent film or other light emitting devices within the polymeric gel material. An electrical power supply is associated with the lighting to provide illumination of informational indicia.

The gel body of the present display device can be a simple geometric shape such as a circle, square or rectangle. The gel body of the display device may be also shaped in an outline of a specific object such as a snowman, candle, football or other much more complicated shapes.

DETAILED DESCRIPTION OF THE INVENTION

Figure 1:
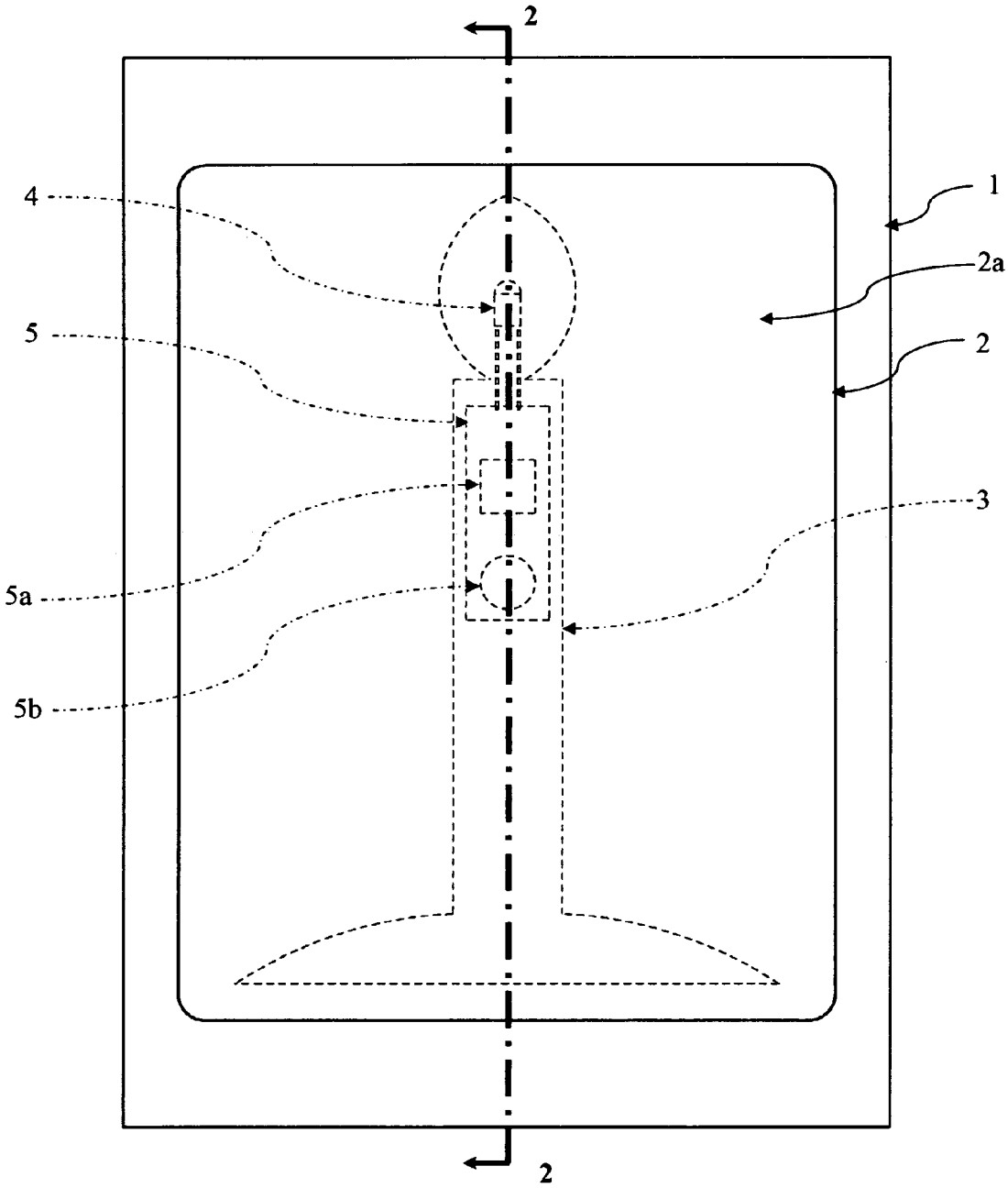
FIG. 1 shows a rear view of one version of the gel display device and attached to a mounting surface.

Referring now to FIG. 1, a mounting surface 1 is depicted with an attached gel display 2. The mounting surface 1 could be, but is not to be limited to, glass, metal, porcelain or any other relatively smooth surface.

As further shown in FIG. 1, the gel display 2 includes a body portion 2*a* that is formed from an over-molding or encapsulate material that encases or carries at least indicia 3, a light emitting device 4 and circuitry including a circuit board 5. The gel material can include various materials such as, but not limited to urethanes, polyacrylates, polybutadienes, ethylene propylene elastomers, silicones, rubbers and other thermo plastic elastomers. The gel material may also be a chemically reacted resin that can be poured or sprayed or could be an injection molded polymer. The thickness of the gel material that forms the gel display 2 is in the range of 0.060 to 0.375 inches, which is clearly outside the range of thicknesses associated with the various static cling film materials used in some prior display devices. Due to its high surface coefficient of friction the gel or polymer material exhibits an inherent tacky or adhesive surface characteristic as well as inherent flexibility. This adhesive property as well as the flexibility of body portion 2*a* allows the gel display 2 to be attached to surfaces 1 that are flat or curved as well as to surfaces oriented at any angle or position. The high oil content of the gel material provides a highly tacky surface that allows the gel material to cling to items or surfaces such as surface 1. The gel material forming this gel display 2 is most effective when presented in a soft or low durometer state such as 3 to 40 shore scale A.

The indicia 3, as shown in FIG. 1, is depicted as the outline of a candle, however, it is understood that the indicia 3 may have the shape of most any graphical representation. For example, the indicia 3 could easily represent various holidays, sports and sporting events, advertising, company logos or other unlimited forms of graphics including photographs. Preferably, the indicia 3 is an insert molded laminate that is embedded into the gel material. The indicia 3 can also be molded into surface of the gel material itself, thus not incurring the additional cost of printing the indicia 3. The indicia 3 may further be printed directly on either the front or back surface of the gel material. The indicia 3 can be translucent or may be opaque in specific areas and may also take the form of a dynamic display such as a liquid crystal display (LED) with the ability to change images and colors.

Throughout the several drawing figures, numeral 4 represents a light emitting device. This light emitting device 4 can be a single light emitting diode (LED) as shown but, may further include, multiple LEDs arranged in a random pattern or in a symmetrical matrix for providing the above-mentioned dynamic capability and ability to change images and colors. The light emitting device 4 is preferably over-molded or embedded within the gel material. The light emitting device 4 can also be any type of electroluminescent film, incandescent bulb, neon or fluorescent light.

Figure 2:
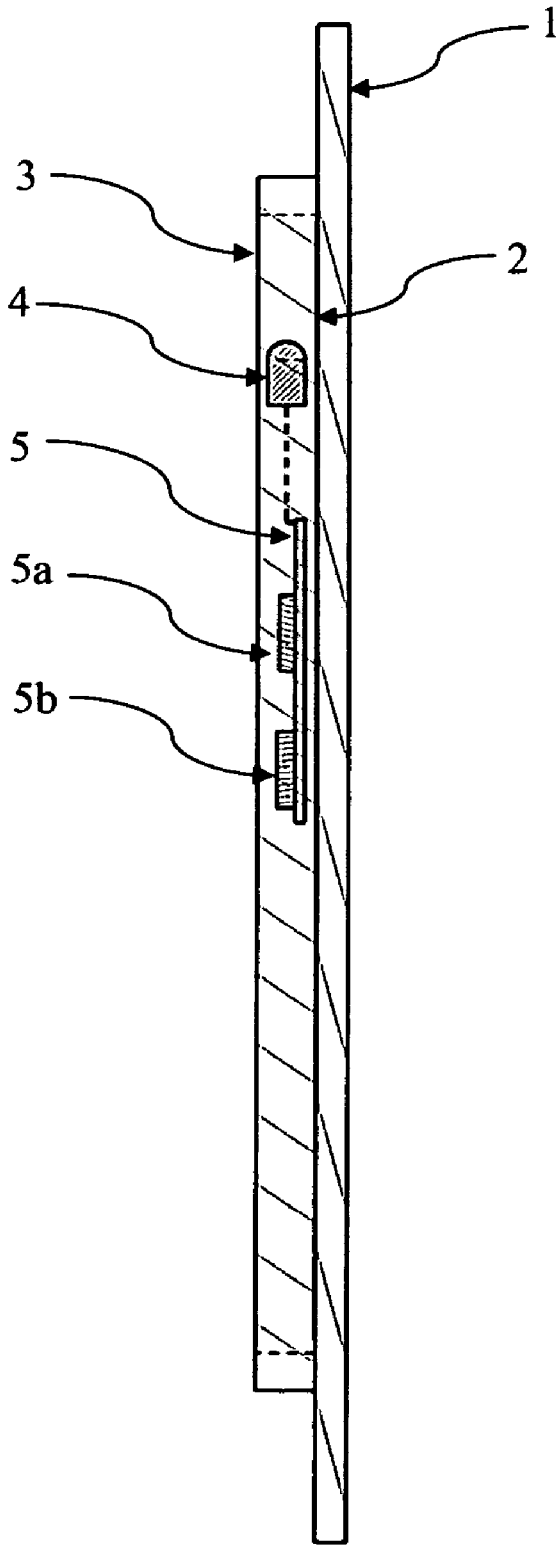
FIG. 2 is a cross-section view taken generally along lines 2-2 of FIG. 1.

As depicted in the various drawing figures, the circuit board 5 for the gel display 2 is preferably molded in place within the gel display 2. As indicated in FIGS. 1 and 2, numeral 5*a* represents components mounted on the circuit board 5 to provide control of the light emitting device 4 and generally would include a switch. As also shown in FIGS. 1 and 2, numeral 5*b* represents a power source. The power source 5*b* may include single or multiple batteries. The power source 5*b* may also include an alternating current (AC) power source with a power cord (not shown) that would extend from the gel display 2 to a source of AC power. Further, the power source 5*b* may include a solar panel that would charge a battery or batteries associated with the circuit board 5. While the instant invention has been described for backlighting indicia 3, it is anticipated that the gel display can also be used simply as a lighting device by over-molding the light emitting device 4, the circuit board 5 and the power source 5*b* within the gel material.

Figure 20:
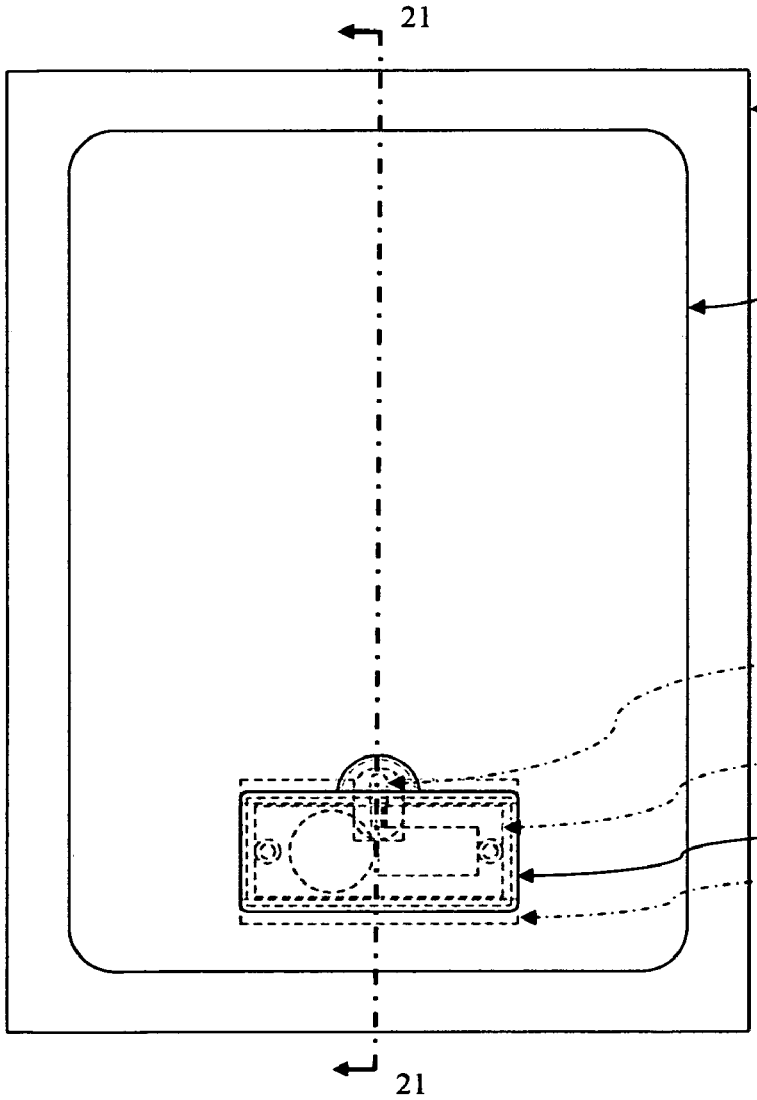
FIG. 20 is a view showing an alternative mounting arrangement for the lighting and power supply components.
Figure 21:
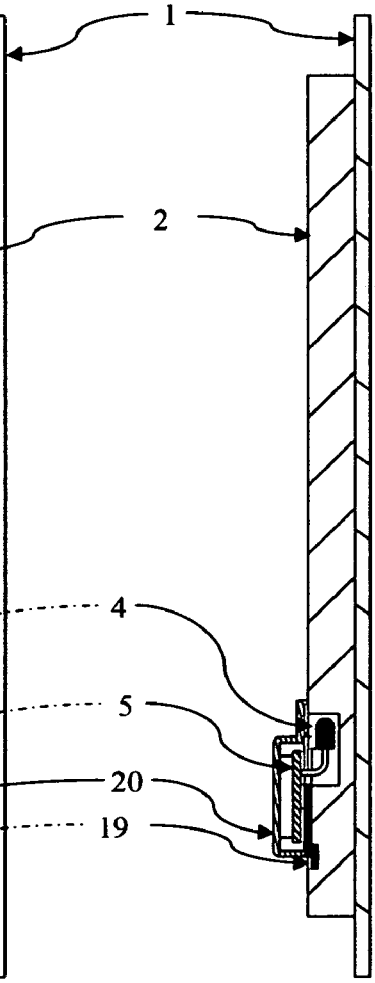
FIG. 21 is a cross-section view taken along lines 21-21 of FIG. 20.

It is further anticipated that, as shown in FIGS. 20 and 21, the circuit board 5 including circuit components 5*a* and the power source 5*b* need not be encapsulated within the body portion 2*a* of gel display 2. Rather, the gel display 2 may include a separate receptor or circuit board mounting plate 19 at least partially molded into a cavity located on an edge of the gel display 2 and the circuit board 5 would be attached to the plate 19. The mounting plate 19 and circuit board 5 would then be enclosed by a cover 20.

Figure 3:
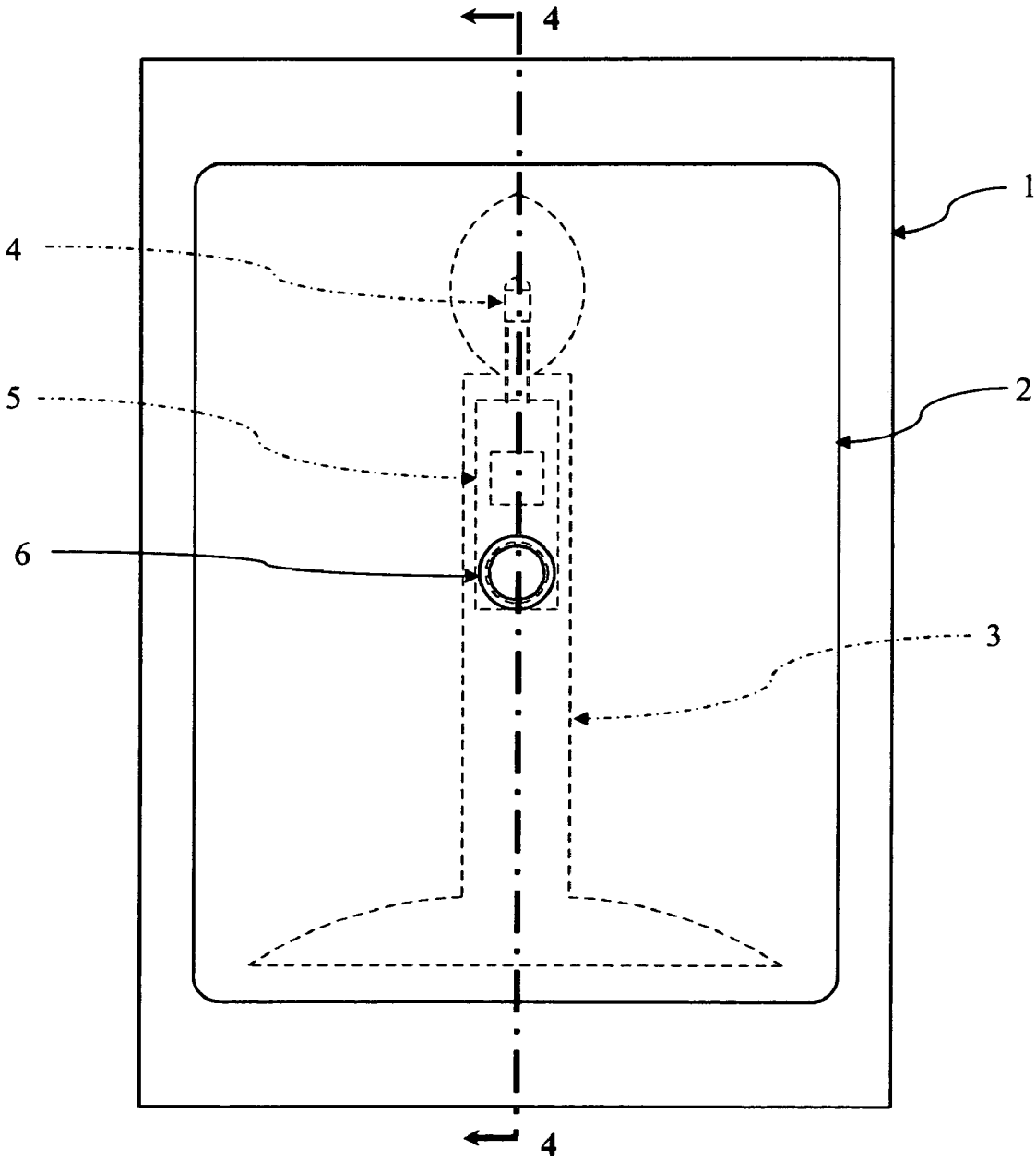
FIG. 3 shows the rear view of a second embodiment of the gel display device.
Figure 4:
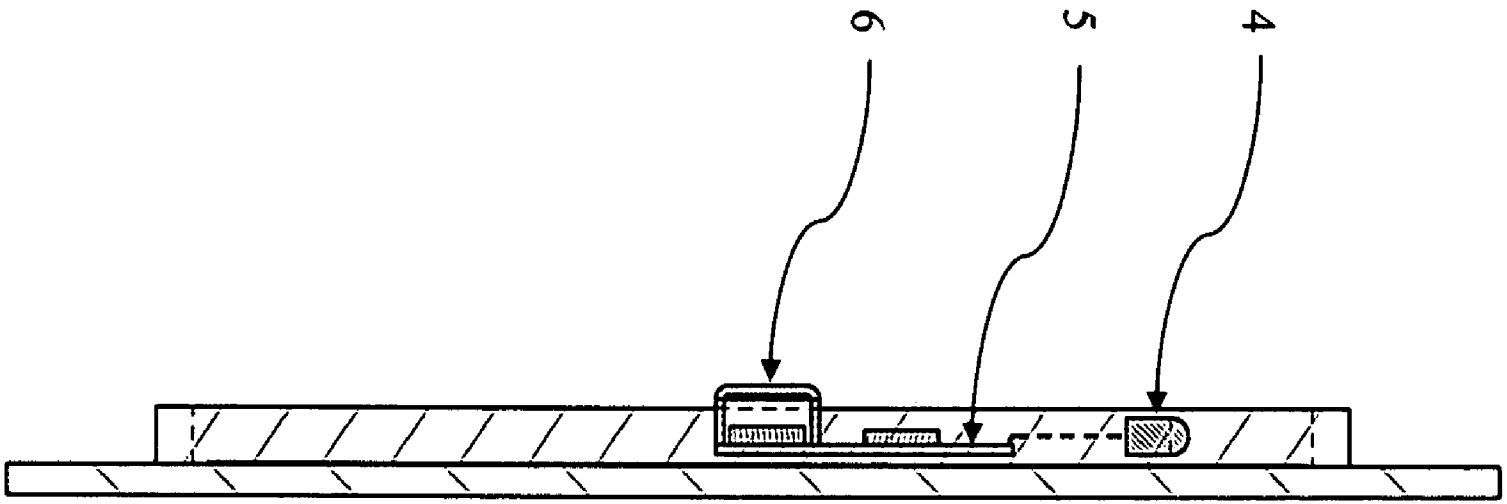
FIG. 4 is a cross-section view taken generally along lines 4-4 of FIG. 3.

FIGS. 3 and 4 show rear and sectional views of another version of the gel display 2. In these figures, numeral 6 represents a component cover designed to protrude through the rear surface of the gel material. Providing component cover 6 allows for replacement of a component such as a battery or may allow for the use of a larger component.

Figure 5:
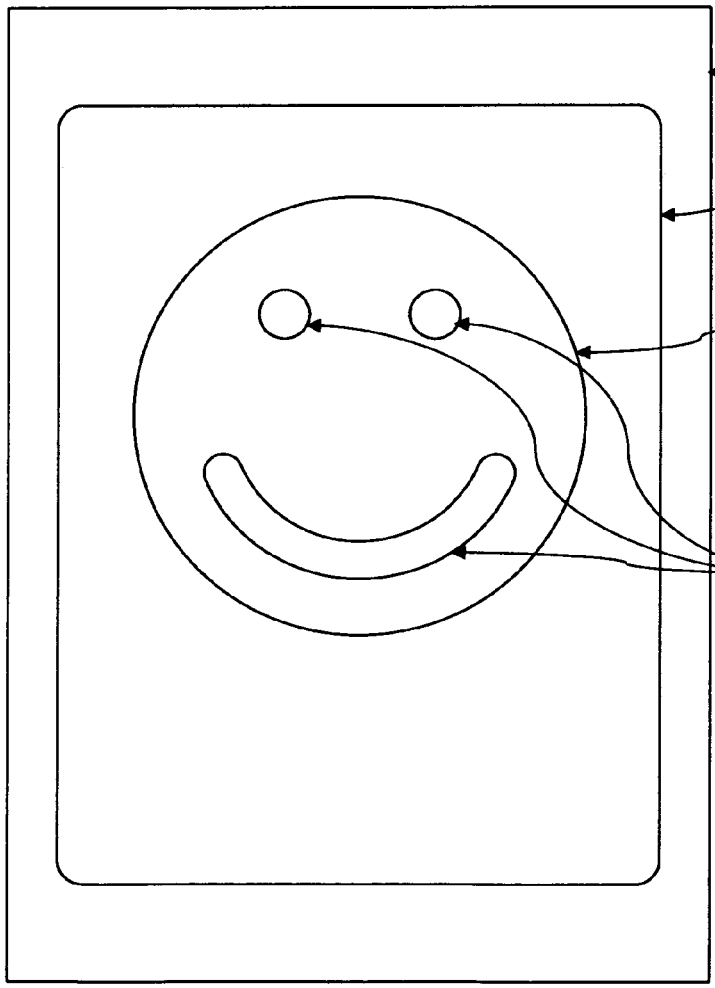
FIG. 5 shows the back view of another version of the gel display device.
Figure 6:
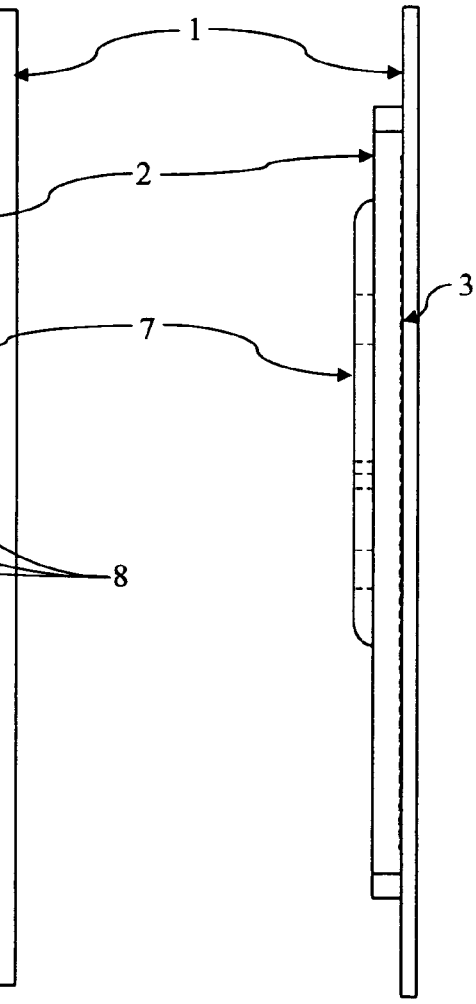
FIG. 6 shows a side view of the gel display device shown in FIG. 5.

FIG. 5 shows the rear view of yet another version of the gel display 2 and FIG. 6 shows a side view of the gel display 2 of FIG. 5. Again, in FIGS. 5 and 6, there is shown the mounting surface 1, the gel display 2, and the indicia 3. The indicia 3, is shown in FIG. 6 as being embedded below the mounting surface 1. Further, shown in FIG. 5 is a graphic item 7 depicted as a three dimensional figure protruding outward from the back plane of the gel material of the gel display 2. In FIG. 5, open areas 8 represent open portions in the graphic item 7 that extend towards the body of the gel display 2 and which fill with gel material during molding of the display 2. It is further contemplated that any three-dimensional shape or graphic item 7 could be formed on the backside of the gel display 2. The three-dimensional shape or graphic item 7 may have associated indicia printed on it or separate indicia could be molded into the gel material of the gel display 2. The three-dimensional shape or graphic item 7 may also have a texture molded on the surface. Optionally, graphic item 7 may simply be a segment or portion molded from a different color gel material.

Figure 7:
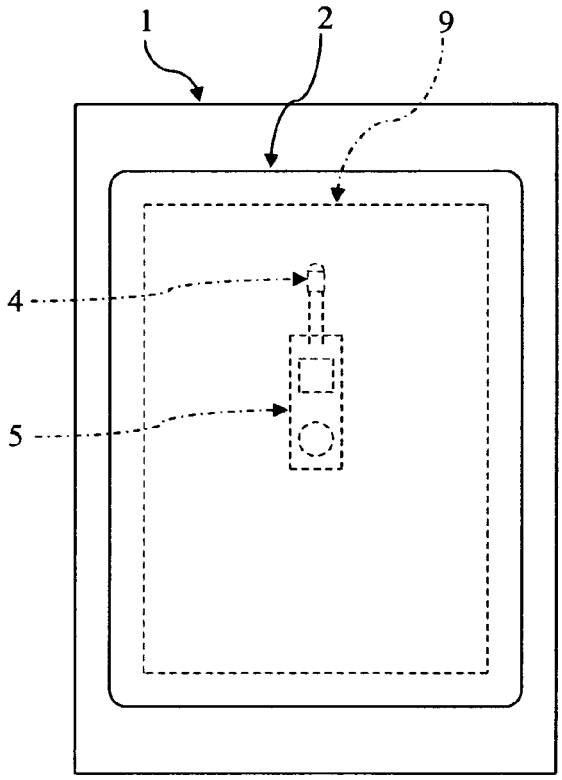
FIG. 7 shows a rear view of yet another version of the gel display device and attached to a mounting surface.
Figure 8:
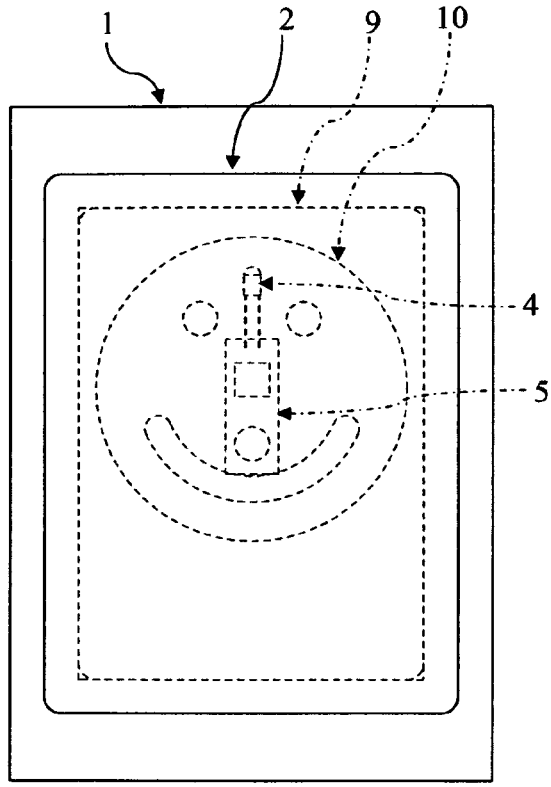
FIG. 8 shows the display device of FIG. 7 with a changeable graphic inlay inserted into a recessed area.

FIG. 7 shows another gel display 2 from the backside and attached to a mounting surface 1. In this configuration, a recessed area 9 is formed on the front side of the gel display 2 that can receive various changeable graphic inlays. FIG. 8 shows the same gel display 2 of FIG. 7 but with a changeable graphic inlay 10, inserted into the recessed area 9. The graphic inlay 10 can be held in place by the adherent, tacky properties of the gel material of the gel display 2. The graphic inlay 10 can be made from but is certainly not limited to vinyl, polyester, polypropylene and polyethylene films with printed indicia. Although not shown in FIGS. 7 and 8, the recessed area 9 could be on multiple surfaces of the gel display 2 and can vary in size and shape from that shown. The graphic inlay, 10 can also be a three-dimensional insert or a photograph.

Figure 9:
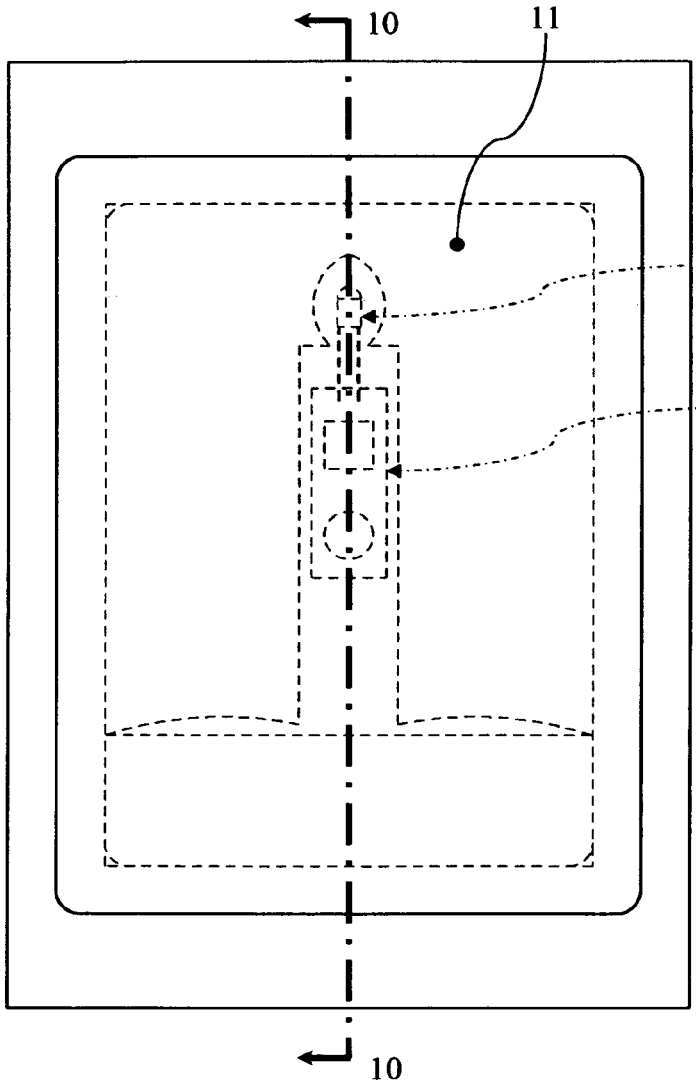
FIG. 9 is a view similar to FIG. 7 shown with a different inlay graphic.
Figure 10:
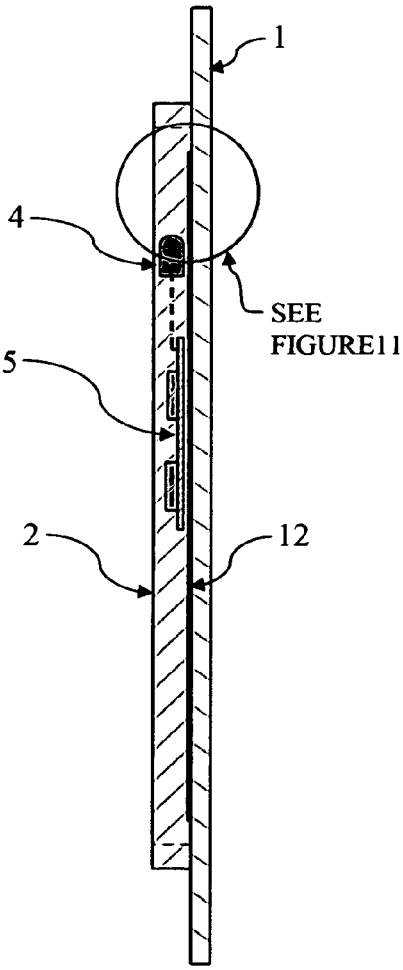
FIG. 10 is a cross-section taken generally along lines 10-10 of FIG. 9.
Figure 11:
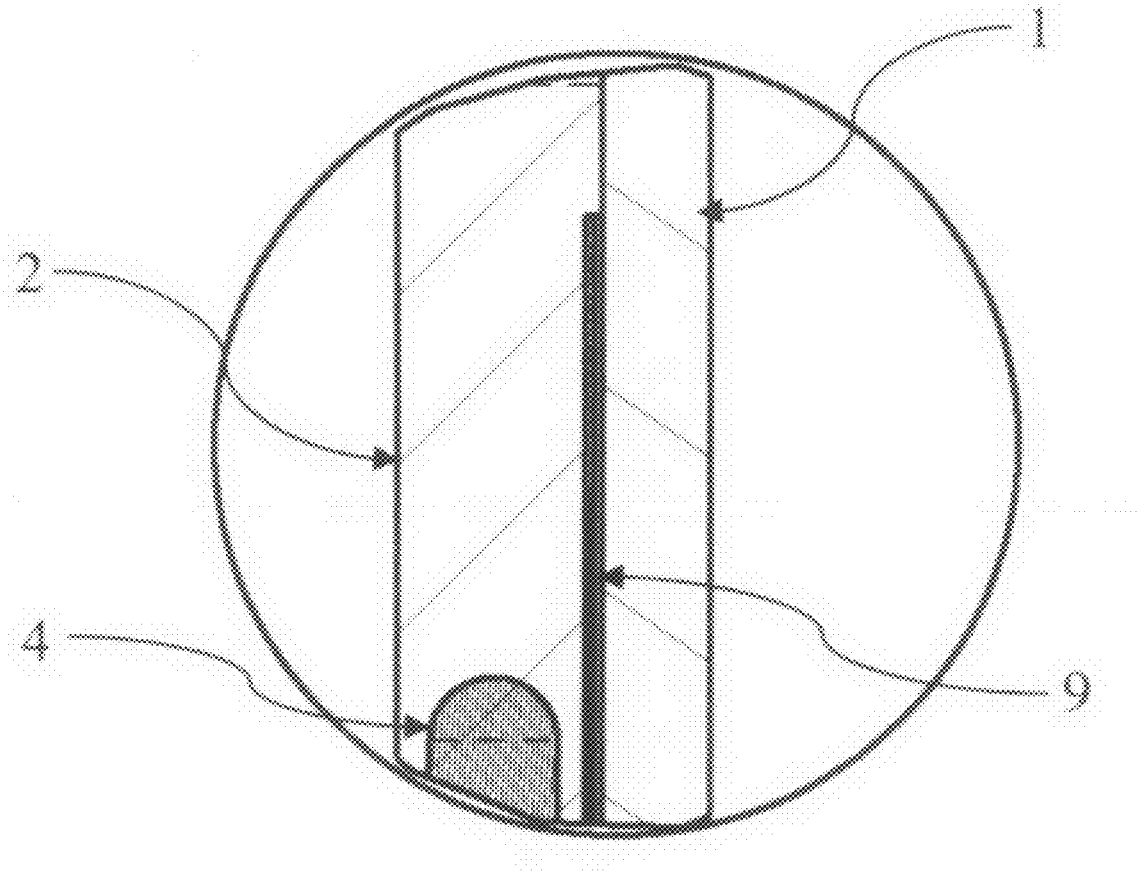
FIG. 11 is an enlarged detail view of an area from FIG. 10.

FIG. 9 is similar to FIG. 7 with the exception that the graphic inlay 10 has been replaced with a different graphic inlay 11. FIG. 10 further shows of a recessed area 12 for receiving the removable graphic inlay 11. The recessed area 12 is best shown in FIG. 11, which is an enlarged detail area taken from FIG. 10.

Figure 12:
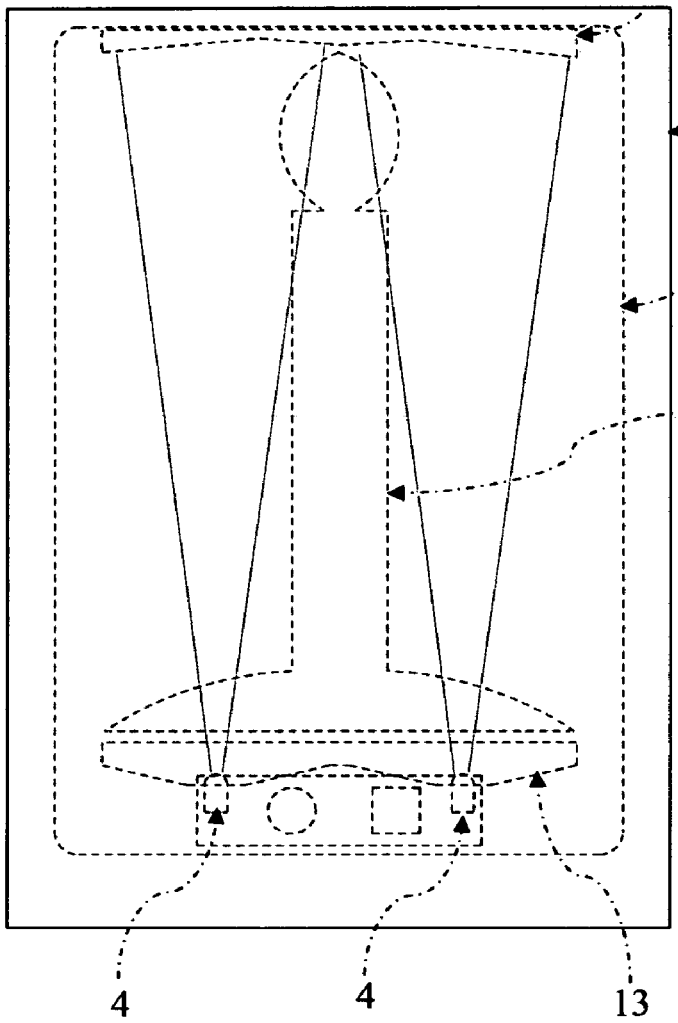
FIG. 12 is a view showing the transmitting of light within the gel body using a light spreader.

There are several ways to provide back/front lighting for the gel display 2 of the present invention. With a clear gel, display light can be transmitted along different paths within the gel material itself. FIG. 12 shows a system for transmitting light within the gel material by using a light spreader bar 13. The light is transmitted parallel to the plane of the mounting surface 1 to which the gel display 2 is attached. A light emitting device 4 is coupled to the light spreader bar 13. The light spreader bar 13 is shaped to disperse the light over a wide area for uniform back lighting within the gel material of the gel display 2. For further improving backlighting, a reflector bar 14 can be used to reflect the light back along a different path.

Figure 13:
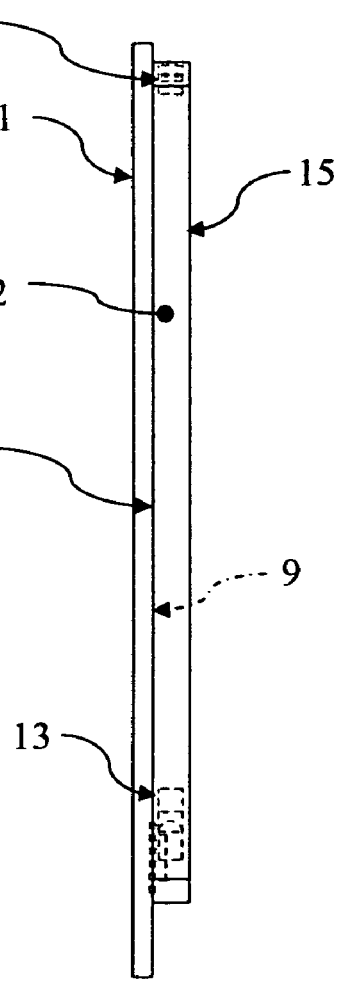
FIG. 13 is a side view of the gel display device of FIG. 12.

FIG. 13 shows a side view of the gel display 2 of FIG. 12. In FIG. 13, the indicia 3 is shown mounted in a recess 9 and against the mounting surface 1. For this type of gel display 2 the indicia 3 can also be mounted in a recess (not shown) formed in the back surface 15 of the display 2.

Figure 14:
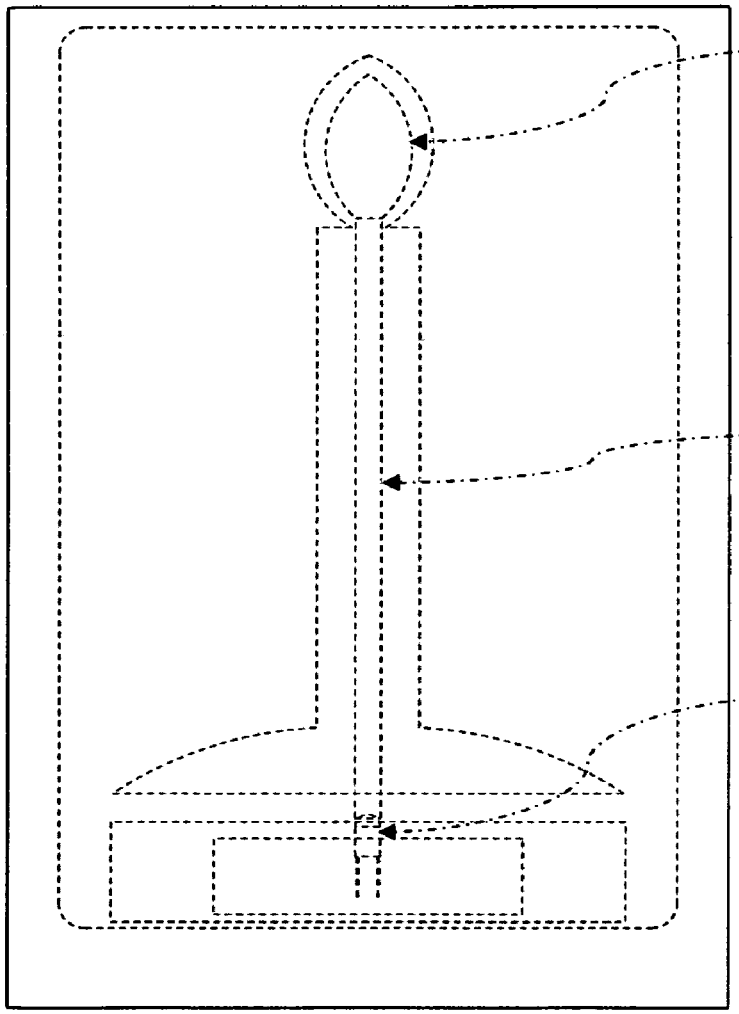
FIG. 14 is a view of a gel display device having a light piping arrangement.
Figure 15:
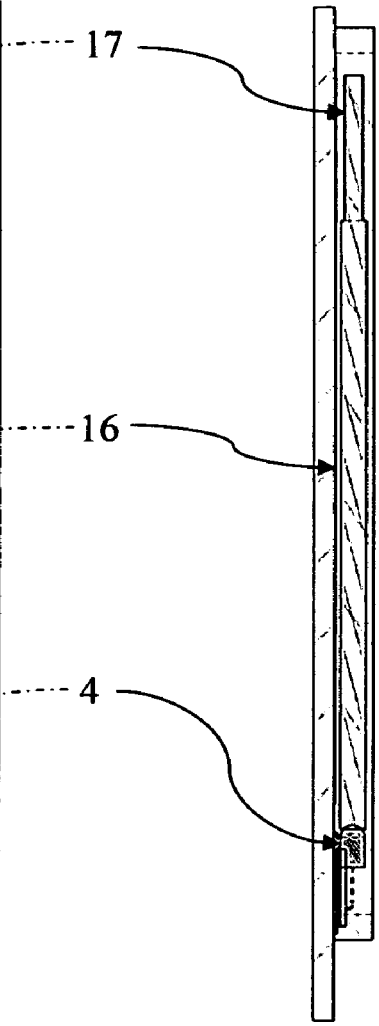
FIG. 15 is a side view of the gel display device of FIG. 14.

FIGS. 14 and 15 illustrate yet another method of dispersing light within the gel display 2. This is accomplished by using light pipes or fiber optics embedded within the gel material of gel display 2. FIGS. 14 and 15 show a gel display 2 having a single light emitting device 4. The light is transferred from the light emitting device 4 to the lighted area using a light pipe 16 to light a particular display area 17. The light pipe 16 could also be located on the surface or outside of the gel body of the display 2. In addition, there may be several light pipes 16 extending from multiple light emitting devices 4 to illuminate different areas of the gel display 2. If fiber optics are utilized the fibers may be located either inside or outside of the gel body of the gel display 2.

Figure 16:
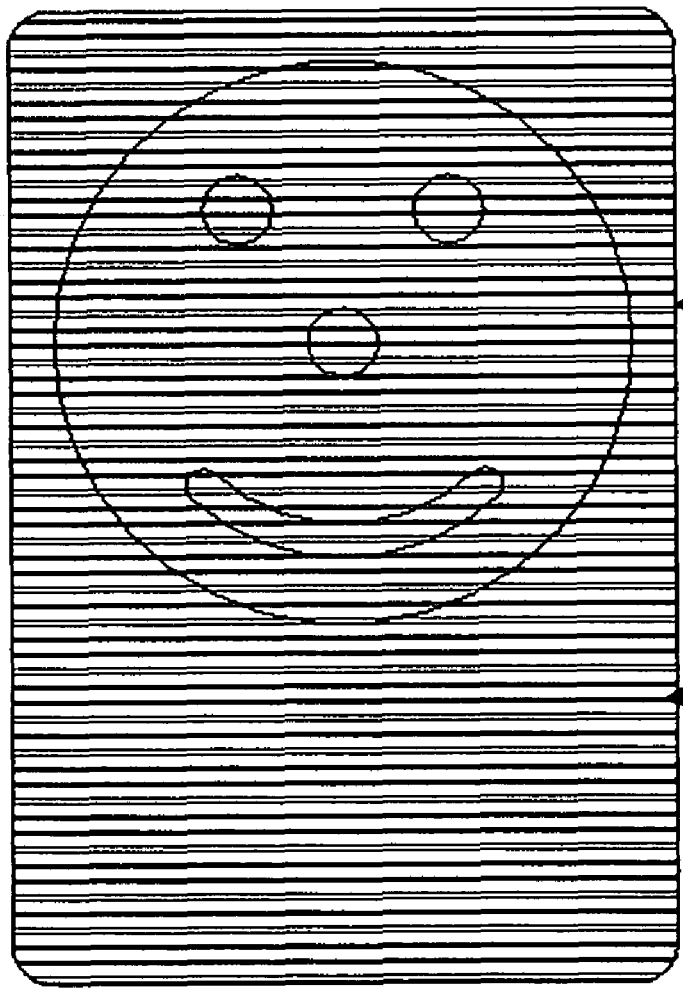
FIG. 16 is a view depicting a gel display device having alternative light spreading features.
Figure 17:
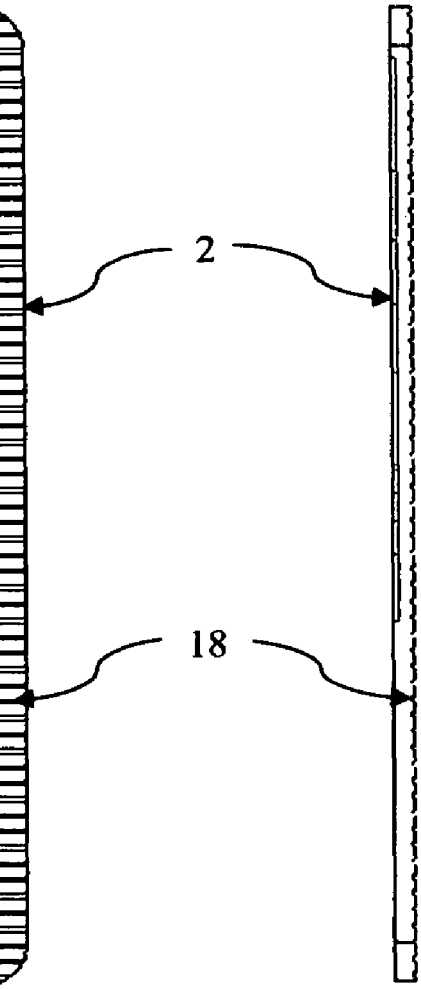
FIG. 17 is a side view of the embodiment of FIG. 16.
Figure 18:
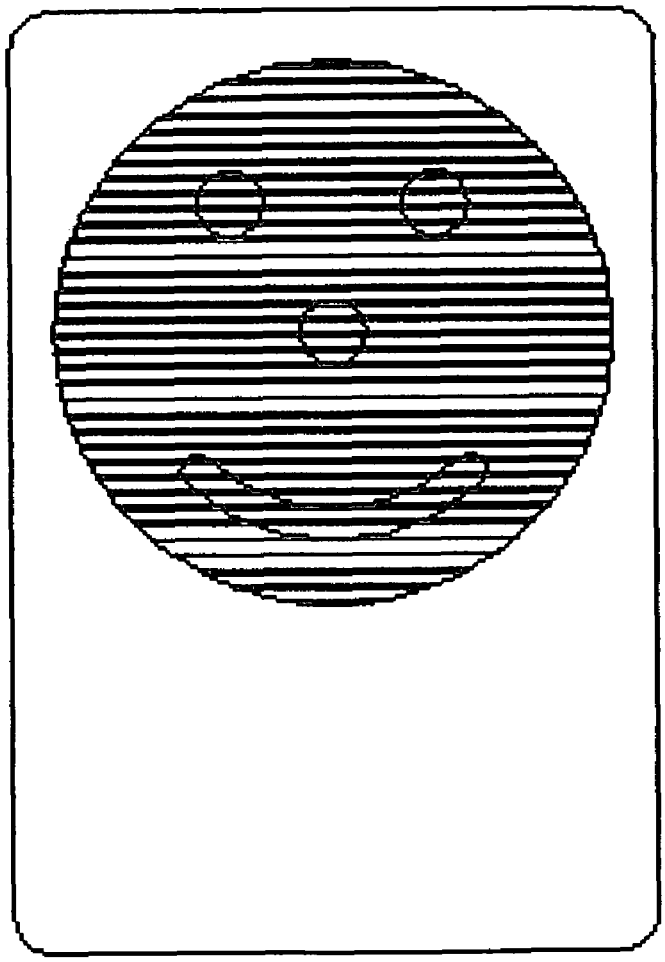
FIG. 18 is a view showing enhancement of a specific area of the gel display device.
Figure 19:
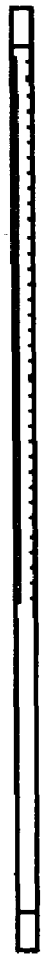
FIG. 19 is a side view of the gel display device of FIG. 18.

As best shown in FIGS. 16 and 17, the surface of the gel display 2 may have a texture such as steps or a pattern molded into the gel which helps to spread the light. The horizontal lines 18 represent steps or a pattern or texture in surface of the gel material to spread the light emanating from a light emitting device 4. The texture or pattern may cover the entire surface of the gel material or may be used to enhance a specific area such as that shown in FIGS. 18 and 19.

Preferably, the gel display 2 is made by loading components such as: the indicia 3, conductors, mechanical and electrical components 4, 5, 5*a*, 5*b* and 6 into a cavity, mold or platen. The gel material is then poured, sprayed or injected around the various components. When the gel material has solidified, the assembly is removed from the cavity, mold or platen. The indicia 3 is printed or formed on a film or component of an acceptable configuration such that when it is placed in the cavity and the cavity is filled with gel material the gel material flows around or through the indicia 3. This allows the indicia 3 to be embedded within the gel material. The indicia 3, when embedded within the gel material, allows the entire mounting surface of the assembly forming the gel display device 2 to have an adhesive or tacky surface. A portion of the indicia bearing film or component may extend outside the boundaries of the gel during this process in order to position it during the application of the gel material. After the gel has set or cured the excess indicia bearing member may be trimmed away. It is also anticipated that the indicia 3 may be located within the mold so that a tab portion of the indicia 3 extends into the mold gate area. This allows the tab to split the flow of gel material injected into the mold causing the gel material to flow around both sides of the indicia 3 and evenly fill the mold.

There has been provided a unique design for a gel display 2 that can be mounted to a surface by means of the inherent adherent or tacky characteristics of the gel material. Several other features that may be included are solar cells mounted in the gel to charge the on board power source. Sound emitting or receiving devices can also be applied or mounted within the gel material. Other devices envisioned include programmable control components for controlling the light emitting devices in terms of intensity, flashing, strobe and fade effects to name a few. Although not shown in any of the figures an electroluminescent can also be used as a light source for providing back lighting. In addition, the graphics can be created using a dynamic display such as a thin film transistor (TFT) or liquid crystal display (LCD). Communication devices can be associated with the gel display such that the gel display can communicate through hard wired or wireless external devices including computers or other gel displays to provide for at least remote adjustment of information that is displayed.

In the drawings and specification, there has been set forth a preferred embodiment of the invention and although specific terms are employed these are used in a generic and descriptive sense only and not for purposes of limitation. Changes in form and the proportion of parts as well as the substitution of equivalents are contemplated as circumstances may suggest or render expedient without departing from the spirit or scope of the invention as further defined in the following claims.

What is claimed is:

1. A display device comprising:

an illumination assembly including an electrical power supply and a light source;

indicia means interactively associated with said illumination assembly for displaying pertinent information; and a body portion molded from a high oil content polymer gel material that surrounds and at least partially embeds said illumination assembly and said indicia means within and said body portion, said body portion further defining the outer boundaries of the display device whereby said illumination assembly and said indicia means are at least partially embedded within said high oil content polymer gel material.

2. A display device as described in claim 1 wherein said high oil content polymer gel material has a high surface coefficient of friction to allow said display device to be adhered to a mounting surface.

3. A display device as described in claim 1 and further including light spreading means cooperable with said illumination assembly for distributing light from said light source.

4. A display device as described in claim 3 wherein said light spreading means includes a light spreader bar and a reflector bar disposed within said body portion.

5. A display device as described in claim 3 wherein said light spreading means includes a light pipe disposed within said body portion.

6. A display device as described in claim 3 wherein said light spreading means includes fiber optics disposed within said body portion.

7. A display device as described in claim 3 wherein said light spreading means includes a generally random texture pattern molded into a surface of said body portion.

8. A display device comprising:

an illumination assembly including an electrical power supply, a light source and a switch electrically interposed between the light source and the electrical power supply;

light spreading means cooperable with said illumination assembly for distributing light from said light source within said display device;

indicia means including means for displaying pertinent information and interactively associated with said illumination assembly and said light spreading means;

a molded body portion formed from a high oil content polymer gel material that surrounds and embeds said illumination assembly, said light spreading means and said indicia means within said body portion, said body portion further defining the outer boundaries of the display device with said illumination assembly, said light spreading means and said indicia means being totally embedded within said gel material; and a removable cover for providing access to at least said power supply.

9. A display device as described in claim 8 wherein said illumination assembly is located with respect to said indicia means to provide back lighting of said indicia means.

10. A display device as described in claim 8 wherein said illumination assembly is located with respect to said indicia means to provide front lighting of said indicia means.

11. A display device as described in claim 8 wherein said indicia means includes printing on the surface of said body portion.

12. A display device as described in claim 8 wherein said body portion is molded from at least two colors of translucent high oil content gel material.

13. A display device as described in claim 8 wherein said device includes circuitry cooperable with external devices for changing and updating information to be displayed.

14. A display device comprising:

an illumination assembly including an electrical power supply, a light source and a switch electrically interposed between said light source and said electrical power supply;

light spreading means cooperable with said illumination assembly for distributing light from said light source within said display device;

indicia means interactively associated with said illumination assembly and said light spreading means for displaying information pertinent to said display device, said indicia means further including sound receiving and emitting devices; and a body portion formed from a high oil content polymer gel material molded around and completely embedding said illumination assembly and said light spreading means within said body portion, said body portion further defining the outer boundaries of the display device with said illumination assembly and said light spreading means being embedded within said gel material, said body portion still further including a recessed area for mounting said indicia means in an interchangeable posture.

15. A display device as described in claim 14 wherein illumination assembly said includes a dynamic light source.

16. A display device comprising:

a molded body portion defining the outer boundaries of the display device and formed from a high oil content polymer gel material, the body portion including a cavity adjacent an edge thereof;

a circuit mounting plate molded at least partially into said body portion and located at least partially within said cavity;

an illumination assembly removably attached to said circuit mounting plate and including an electrical power source, a light source and a switch electrically interposed between said light source and said electrical power source; indicia means interactively associated with said body portion and said illumination assembly for displaying information pertinent to said display device; and a removable cover for providing access to at least said electrical power source.

* * * * *